US007628577B2

(12) United States Patent
Hablanian

(10) Patent No.: US 7,628,577 B2
(45) Date of Patent: Dec. 8, 2009

(54) VACUUM PUMPS WITH IMPROVED PUMPING CHANNEL CONFIGURATIONS

(75) Inventor: Marsbed Hablanian, Wellesley, MA (US)

(73) Assignee: Varian, S.p.A., Leini, Turin (IT)

( * ) Notice: Subject to any disclaimer, the term of this patent is extended or adjusted under 35 U.S.C. 154(b) by 475 days.

(21) Appl. No.: 11/513,715

(22) Filed: Aug. 31, 2006

(65) Prior Publication Data

US 2008/0056885 A1 Mar. 6, 2008

(51) Int. Cl.
*F01D 1/36* (2006.01)

(52) U.S. Cl. ..... 415/90; 415/55.1; 415/55.4; 415/55.6

(58) Field of Classification Search ..... 415/90, 415/55.1, 55.4, 55.6
See application file for complete search history.

(56) References Cited

U.S. PATENT DOCUMENTS 3,402,669 A * 9/1968 Mamo ..... 415/26
4,655,678 A * 4/1987 Miki ..... 415/71
5,221,179 A 6/1993 Ikegami et al.
5,238,362 A 8/1993 Casaro et al.
5,358,373 A 10/1994 Hablanian
5,456,575 A 10/1995 Helmer et al.
5,482,430 A * 1/1996 Hablanian ..... 415/90
5,695,316 A 12/1997 Schuetz et al.
5,848,873 A 12/1998 Schofield
6,135,709 A 10/2000 Stones
6,409,468 B1 * 6/2002 Kawasaki ..... 415/71
6,607,351 B1 8/2003 Hablanian
2003/0219337 A1 * 11/2003 Cerruti et al. ..... 415/90

FOREIGN PATENT DOCUMENTS

EP 1170508 A 1/2002
EP 1361366 A 11/2003

OTHER PUBLICATIONS

PCT/US2007/019059, PCT International Search Report, mailed Jan. 3, 2008, 5 pages.

* cited by examiner

*Primary Examiner*—Igor Kershteyn
(74) *Attorney, Agent, or Firm*—Bella Fishman

(57) ABSTRACT

A vacuum pump includes a housing having an inlet port and an exhaust port, at least one molecular drag stage within the housing, the molecular drag stage including a rotor and a stator that defines a tangential flow channel which opens onto a surface of the rotor, and a motor that rotates the rotor so that gas is pumped from the inlet port to the exhaust port. The stator defines one or more obstructions in the channel. The obstructions alter gas flow through the channel and produce turbulence under viscous or partially viscous flow conditions.

8 Claims, 7 Drawing Sheets

VACUUM PUMPS WITH IMPROVED PUMPING CHANNEL CONFIGURATIONS

FIELD OF THE INVENTION

This invention relates to turbomolecular vacuum pumps and hybrid vacuum pumps and, more particularly, to vacuum pumps having pumping channel configurations which assist in achieving improved performance in comparison with prior art vacuum pumps.

BACKGROUND OF THE INVENTION

Conventional turbomolecular vacuum pumps include a housing having an inlet port, an interior chamber containing a plurality of axial pumping stages and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high rotational speed by a motor to pump gas between the inlet port and the exhaust port. A typical turbomolecular vacuum pump may include nine to twelve axial pumping stages.

Variations of the conventional turbomolecular vacuum pump, often referred to as hybrid vacuum pumps, have been disclosed in the prior art. In one prior art configuration, one or more of the axial pumping stages are replaced with molecular drag stages, which form a molecular drag compressor. This configuration is disclosed in U.S. Pat. No. 5,238,362, issued Aug. 24, 1993 and assigned to Varian, Inc. sells hybrid vacuum pumps including an axial turbomolecular compressor and a molecular drag compressor in a common housing. Molecular drag stages and regenerative stages for hybrid vacuum pumps are disclosed in Varian, Inc. owned U.S. Pat. No. 5,358,373, issued Oct. 25, 1994. Other hybrid vacuum pumps are disclosed in U.S. Pat. No. 5,221,179 issued Jun. 22, 1993; U.S. Pat. No. 5,848,873, issued Dec. 15, 1998 and U.S. Pat. No. 6,135,709, issued Oct. 24, 2000. Improved impeller configurations for hybrid vacuum pumps are disclosed in Varian, Inc.'s owned U.S. Pat. No. 6,607,351, issued Aug. 19, 2003.

Molecular drag stages include a rotating disk, or impeller, and a stator. The stator defines a tangential flow channel and an inlet and an outlet for the tangential flow channel. A stationary baffle, often called a stripper, disposed in the tangential flow channel separates the inlet and the outlet. The momentum of the rotating disk is transferred to gas molecules within the tangential flow channel, thereby directing the molecules toward the outlet. Molecular drag stages were developed for molecular flow conditions. In molecular flow, pumping action is produced by a fast moving flat surface dragging molecules in the direction of movement.

When viscous flow is approached, the simple momentum transfer does not work as well, because of increased backward flow due to the establishment of a pressure gradient rather than a molecular density gradient. As a result, the molecular drag stage may not achieve the desired pressure difference in viscous flow conditions.

Accordingly, there is a need for improved molecular drag stages for vacuum pumps.

SUMMARY OF THE INVENTION

According to a first aspect of the invention, a vacuum pump comprises a housing having an inlet port and an exhaust port, at least one molecular one drag stage located within the housing and disposed between the inlet port and the exhaust port, the molecular drag stage including a rotor comprising a molecular drag disk and a stator that defines a tangential flow channel which opens onto a surface of the disk, the stator further defining at least one obstruction in the channel so as to induce turbulent flow in a selected pressure range, and a motor to rotate the rotor of the molecular drag stage so that gas is pumped from the inlet port to the exhaust port.

According to a second aspect of the invention, a vacuum pump comprises a housing having an inlet port and an exhaust port, at least one molecular drag stage located within the housing and disposed between the inlet port and the exhaust port, the molecular drag stage including a rotor and a stator, the stator defining a tangential flow channel which opens onto a surface of the rotor, a baffle that blocks the channel at a circumferential location, and one or more obstructions in the channel that alter gas flow through the channel, and a motor to rotate the rotor of the molecular drag stage so that gas is pumped from the inlet port to the exhaust port.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
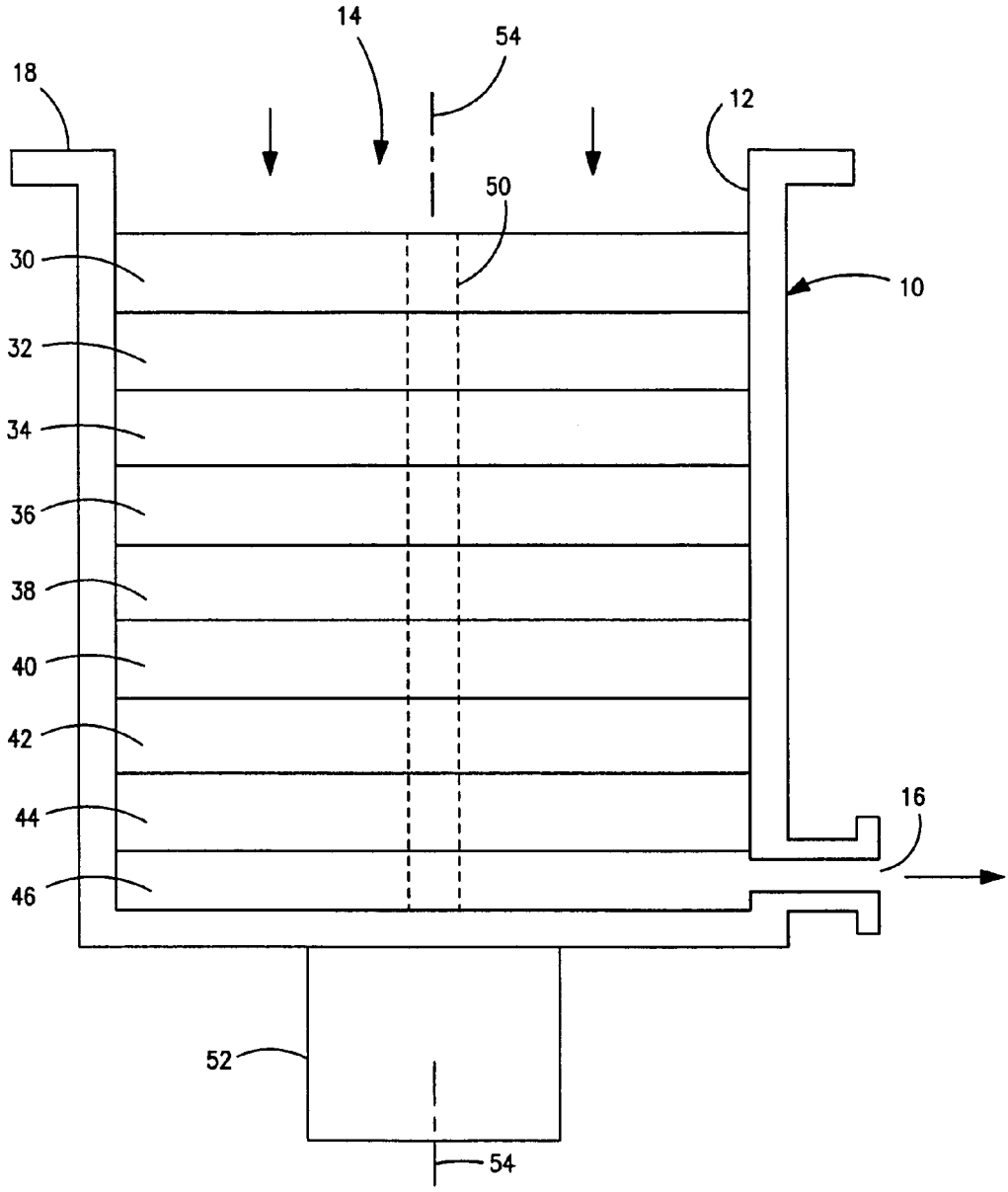
FIG. 1 is a simplified cross-sectional schematic diagram of a vacuum pump suitable for incorporation of the invention.

A simplified cross-sectional diagram of a high vacuum pump in accordance with an embodiment of the invention is shown in FIG. 1. A housing 10 defines an interior chamber 12 having an inlet port 14 and an exhaust port 16. The housing 10 includes a vacuum flange 18 for sealing the inlet port 14 to a vacuum chamber (not shown) to be evacuated. The exhaust port 16 may be connected to a roughing vacuum pump (not shown). In cases where the vacuum pump is capable of exhausting to atmospheric pressure, the roughing pump is not required.

Located within housing 10 are vacuum pumping stages 30, 32, . . . , 46. Each vacuum pumping stage includes a stationary member, or stator, and a rotating member, also known as an impeller or a rotor. The rotating member of each vacuum pumping stage is coupled by a drive shaft 50 to a motor 52. The shaft 50 is rotated at high speed by motor 52, causing rotation of the rotating members about a central axis 54 and pumping of gas from inlet port 14 to exhaust port 16. The embodiment of FIG. 1 has nine stages. It will be understood that a different number of stages can be utilized, depending on the vacuum pumping requirements.

The vacuum pumping stages 30, 32, . . . , 46 may include one or more axial flow vacuum pumping stages and one or more molecular drag stages. In some embodiments, one or more regenerative vacuum pumping stages may be included. The number and types of vacuum pumping stages are selected based on the application of the vacuum pump.

Figure 2:
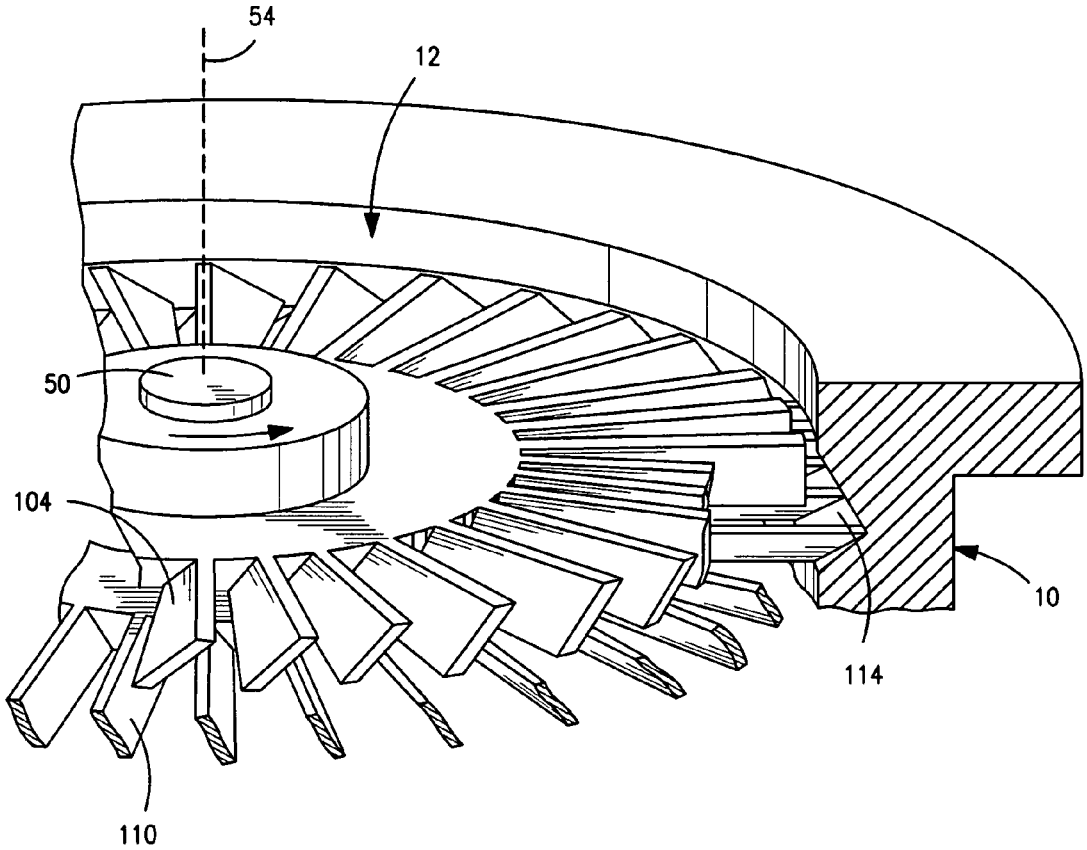
FIG. 2 PRIOR ART
FIG. 2 is a fragmentary perspective view of an axial flow stage that may be utilized in the vacuum pump of FIG. 1.

An example of an axial flow vacuum pumping stage is shown in FIG. 2. Pump housing 10 has inlet port 12. The axial flow stage includes a rotor 104 and a stator 110. The rotor 104 is connected to shaft 50 for high speed rotation about the central axis. The stator 110 is mounted in a fixed position relative to housing 10. The rotor 104 and the stator 110 each have multiple inclined blades. The blades of rotor 104 are inclined in an opposite direction from the blades of stator 110. Variations of conventional axial flow stages are disclosed in the aforementioned U.S. Pat. No. 5,358,373, which is hereby incorporated by reference.

Figure 3:
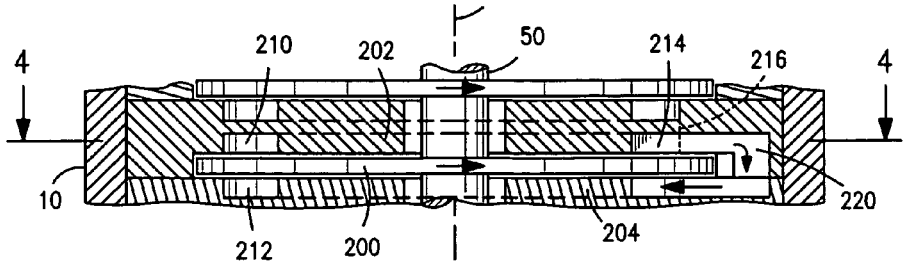
FIG. 3 PRIOR ART
FIG. 3 is a partial cross-sectional view of a vacuum pump utilizing molecular drag vacuum pumping stages.
Figure 4:
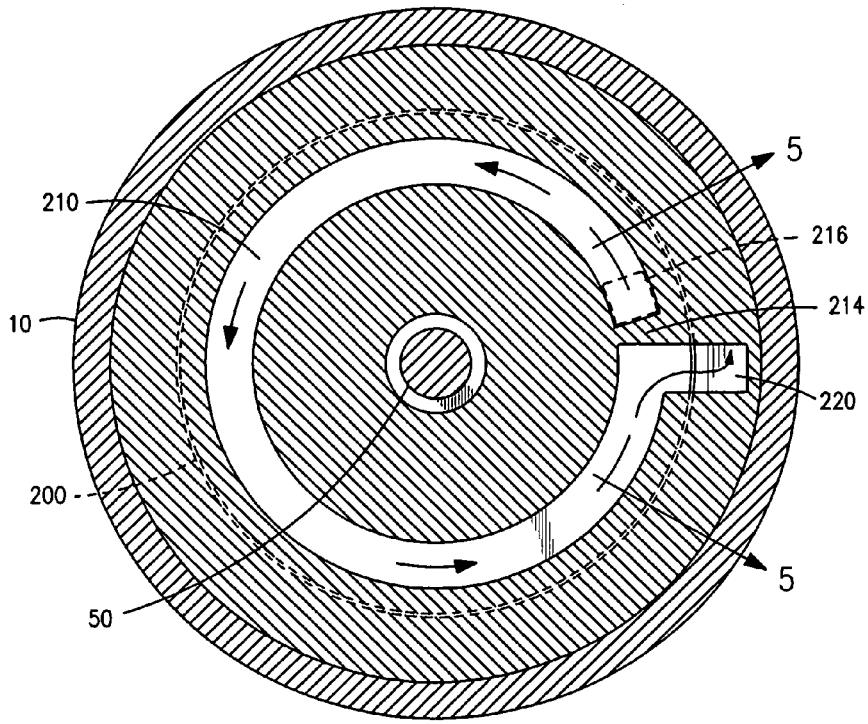
FIG. 4 PRIOR ART
FIG. 4 is a plan view of a molecular drag stage, taken along the line 4-4 of FIG. 3.
Figure 5:
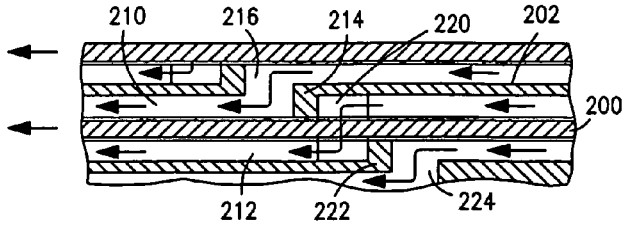
FIG. 5 PRIOR ART
FIG. 5 is a partial cross-sectional view of the molecular drag stage, taken along the line 5-5 of FIG. 4.

An example of a molecular drag vacuum pumping stage is illustrated in FIGS. 3-5. In the molecular drag stage, the rotor, or impeller, comprises a molecular drag disk and the stator is provided with one or more tangential flow channels in closely-spaced opposed relationship to the disk. Each channel has an open side that faces a surface of the disk. When the disk is rotated at high speed, gas is caused to flow through the tangential flow channels by molecular drag produced by the rotating disk. The impeller may have different configurations for efficient operation at different pressures.

Referring to FIGS. 3-5, a molecular drag stage includes a molecular drag disk 200, an upper stator portion 202 and a lower stator portion 204 mounted within housing 10. The upper stator portion 202 is located in proximity to an upper surface of disk 200, and lower stator portion 204 is located in proximity to a lower surface of disk 200. The upper and lower stator portions 202 and 204 together constitute the stator of the molecular drag stage. The disk 200 is attached to shaft 50 for high speed rotation about the central axis 54 of the vacuum pump.

The upper stator portion 202 is provided with an upper channel 210. The channel 210 is located in opposed relationship to the upper surface of disk 200. The lower stator portion 204 is provided with a lower channel 212, which is located in opposed relationship to the lower surface of disk 200. In the embodiment of FIGS. 3-5, the channels 210 and 212 are circular and are concentric with disk 200. The upper stator portion 202 includes a blockage 214, also known as a baffle or a stripper, which blocks channel 210 at a circumferential location between a channel inlet and a channel outlet. The channel 210 receives gas from the previous stage through a conduit 216 (channel inlet) on one side of blockage 214. The gas is pumped through channel 210 by molecular drag produced by rotating disk 200. At the other side of blockage 214, a conduit 220 (channel outlet) formed in stator portions 202 and 204 interconnects channels 210 and 212 around the outer peripheral edge of disk 200. The lower stator portion 204 includes a blockage 222 of lower channel 212 at one circumferential location. The lower channel 212 receives gas on one side of blockage 222 through conduit 220 from the upper surface of disk 200 and discharges gas through a conduit 224 on the other side of blockage 222 to the next stage or to the exhaust port of the pump.

In operation, disk 200 is rotated at high speed about shaft 50. Gas is received from the previous stage through conduit 216. The previous stage can be a molecular drag stage, an axial flow stage, or any other suitable vacuum pumping stage. The gas is pumped around the circumference of upper channel 210 by molecular drag produced by rotation of disk 200. The gas then passes through conduit 220 around the outer periphery of disk 200 to lower channel 212. The gas is then pumped around the circumference of lower channel 212 by molecular drag and is exhausted through conduit 224 to the next stage or to the exhaust port of the pump. Thus, upper channel 210 and lower channel 212 are connected such that gas flows through them in series. In other embodiments, the upper and lower channels may be connected in parallel. Two or more concentric pumping channels can be used, connected in series. While the molecular drag stage of FIGS. 3-5 includes upper and lower channels, other embodiments may include only a single channel. In further embodiments, a peripheral portion of the disk may extend into a channel that includes channel regions above and below the disk and at the outer edge of the disk. Additional embodiments of molecular drag stages are disclosed in the aforementioned U.S. Pat. No. 5,358,373.

When the pressure level in a molecular drag vacuum pumping stage increases from molecular flow to viscous flow, the compression ratio may decrease significantly, thereby degrading performance. According to an aspect of the invention, the tangential flow channel in the stator of the molecular drag stage is configured to increase the pressure level at which the decrease in compression ratio occurs.

Generally speaking, compression ratios in molecular flow are higher than in viscous flow because the molecules are not subject to a reverse pressure gradient due to the absence of intercollisions. When viscous flow conditions are reached, instability develops. Instead of having reasonably uniform density distributions across the channel and along the length of the channel, the flow may separate, find paths of least resistance and may develop backward streamers, or backward flow. This is the phenomenon which reduces the compression ratio.

Depending on the geometry of the pumping channel and the geometric relationship between the moving and stationary surfaces, the backward streamers may develop in different areas of the cross section. For example, in a tube of circular cross section with a moving wall, the backward streamer may develop in the center. In a configuration where the rotating disk extends into the channel, the backward streamers may develop in corners of the channel farthest from the rotating disk. In a channel that faces a surface of a rotating disk, the backward streamer may develop at the position of lowest peripheral velocity.

It has been recognized that the tendency for backward flow is greater in areas of the channel where the velocity of the adjacent rotating disk is relatively low. In addition, the tendency for backward flow is greater in areas of the channel that are farthest from the rotating disk. Thus, for example, backward flow may develop in an area of the channel, such as a corner of the channel, that is closest to the axis of rotation and that is spaced from the rotating disk. These principles are applied to provide channel configurations having improved performance under viscous or partially viscous flow conditions.

The cross-sectional shape of the channel in a conventional molecular drag stage is rectangular, as shown for example in FIG. 3, and is uniform around the circumference of the molecular drag stage. In accordance with embodiments of the invention, the circumferential configuration of the channel is selected to provide improved performance under viscous or partially viscous flow conditions. The channel configurations are selected to produce turbulent gas flow.

According to an aspect of the invention, the circumferential configuration of the channel in the stator is modified to provide improved performance under viscous or partially viscous flow conditions. More particularly, the channel is configured with obstructions which alter gas flow through the channel and which create turbulence in the channel.

Figure 6:
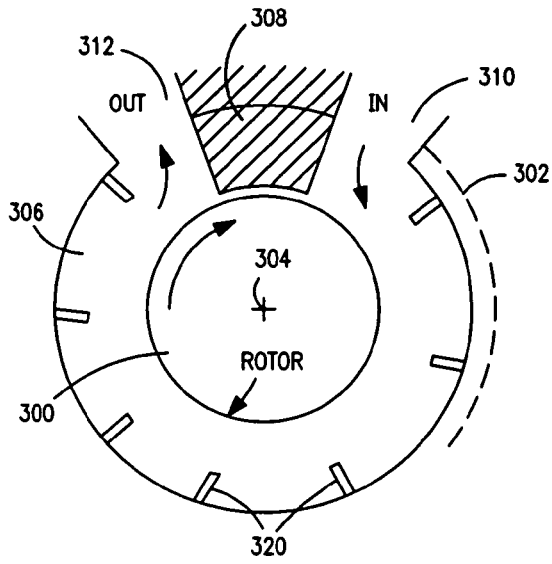
FIG. 6 is a schematic plan view of a molecular drag stage in accordance with an embodiment of the invention.
Figure 6A:
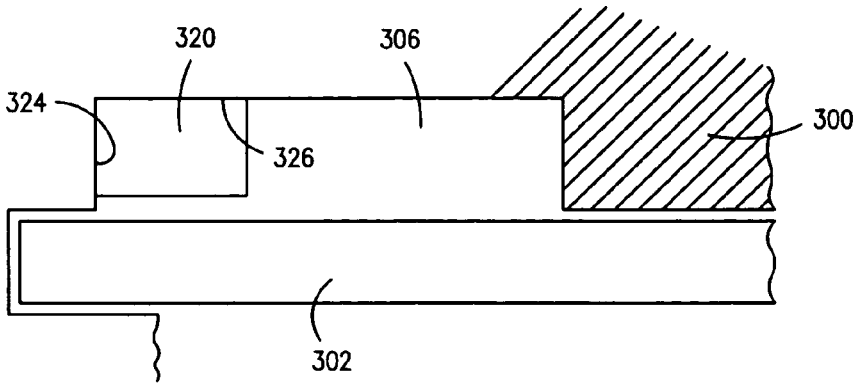
FIGS. 6A-6C are partial cross-sectional views of molecular drag stages in accordance with embodiments of the invention.

A schematic cross-sectional plan view of a molecular drag stage in accordance with a first embodiment of the invention is shown in FIGS. 6 and 6A. The molecular drag stage includes a stator 300 and a rotor in the form of a molecular drag disk 302. Disk 302 rotates about an axis of rotation 304. Stator 300 defines a tangential flow channel 306 that opens onto an upper surface of disk 302. Stator 300 includes a blockage 308 that defines an inlet and an outlet of the tangential flow channel 306. Channel 306 receives gas to be pumped through an inlet conduit 310 and discharges the gas through an exhaust conduit 312 to the next stage or to the exhaust port of the pump.

As shown in FIGS. 6 and 6A, stator 300 includes obstructions 320 spaced apart around the circumference of channel 306. The obstructions 320 may be in the form of radial ribs that at least partially obstruct channel 306. The obstructions 320 alter gas flow through the channel, produce turbulence in channel 306 and reduce the tendency for backward flow under viscous or partially viscous flow conditions. The number of obstructions 320 around the circumference of channel 306, and the size and shape of obstructions 320 relative to the size and shape of channel 306 depends on the expected operating conditions of the molecular drag stage. For example, a larger obstruction produces greater turbulence and permits operation at higher pressure.

Figure 6B:
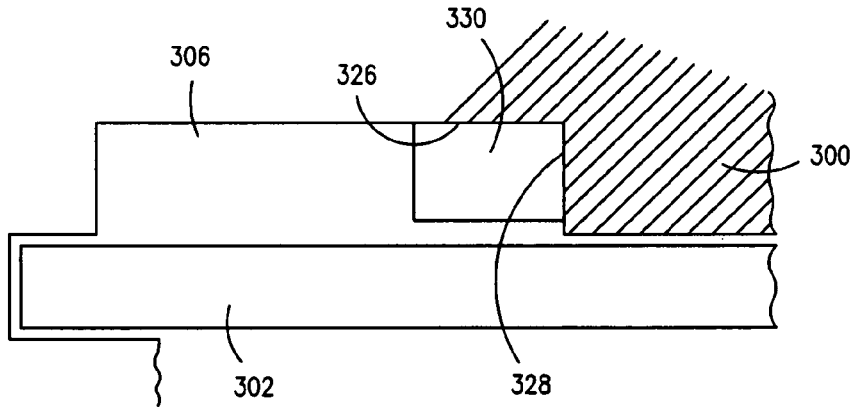
Figure 6C:
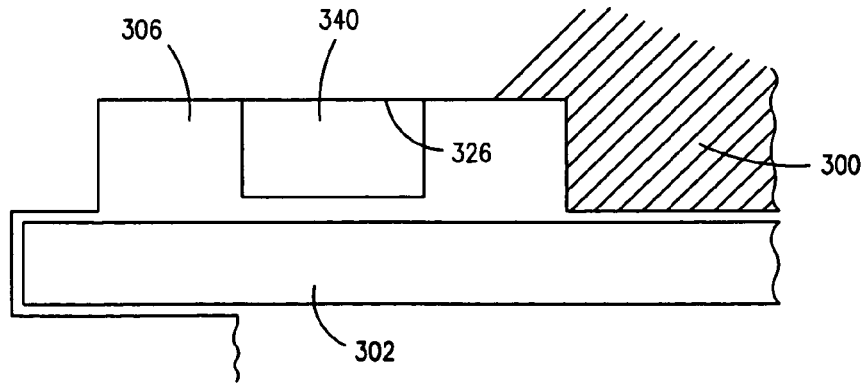

The obstructions in the channel 306 of stator 300 may have various configurations within the scope of the invention. In the embodiment of FIGS. 6 and 6A, obstructions 320 may be affixed to the outer side wall 324 and to the top wall 326 of channel 306. In a second embodiment of FIG. 6B, an obstruction 330 is affixed to the inner side wall 328 and the top wall 326 of channel 306. In a third embodiment of FIG. 6C, an obstruction 340 is affixed to the top wall 326 of channel 306. In each case, the size and shape of the obstructions relative to the size and shape of channel 306 are selected to provide improved performance for a given set of operating conditions. Further, the obstructions within a channel may have different configurations that reduce the tendency for backward flow. For example, the obstructions may alternate between obstruction 320 shown in FIG. 6A and obstruction 330 shown in FIG. 6B. Any other sequence of obstructions may be utilized. In the embodiments of FIGS. 6-6C, the obstructions are configured as ribs or paddles in channel 306.

Figure 7:
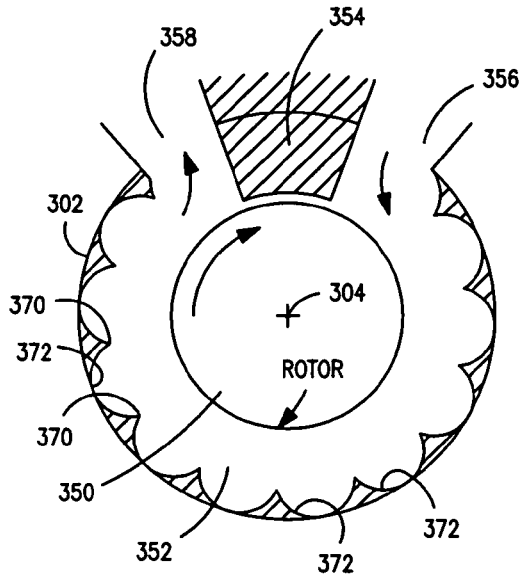
FIGS. 7-9 are schematic plan views of molecular drag stages in accordance with embodiments of the invention.

A schematic cross-sectional plan view of a molecular drag stage in accordance with a fourth embodiment of the invention is shown in FIG. 7. A stator 350 defines a channel 352 that opens onto an upper surface of disk 302. Stator 350 includes a blockage 354 that defines an inlet and an outlet of channel 352. Channel 352 receives gas to be pumped through an inlet conduit 356 on one side of blockage 354 and discharges gas through an exhaust conduit 358 on the opposite side of blockage 354.

In the embodiment of FIG. 7, an outer wall of channel 352 includes a series of spaced apart peaks 370 separated by curved recesses 372. The peaks 370 serve as obstructions to the smooth flow of gas through channel 352 and produce turbulence which in turn reduces the tendency for backward flow in channel 352. The peaks 370 and the recesses 372 can have various shapes and dimensions and can be positioned on the outer wall of channel 352 as shown in FIG. 7, on the inner wall of channel 352, on the top wall of channel 352 or on some combination of the channel walls. The depth of recesses 372 and the spacing between peaks 370 can also be varied.

Figure 8:
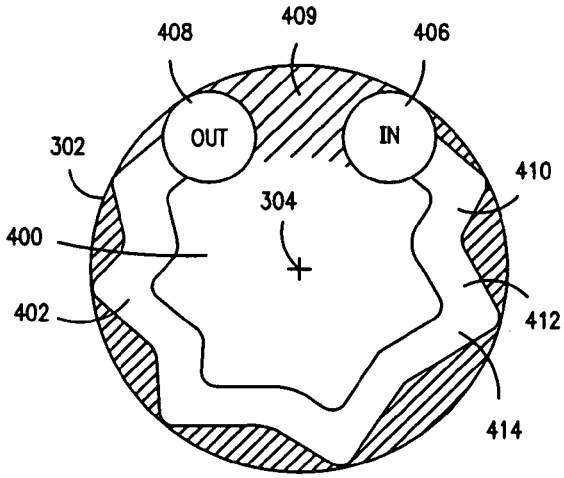

A schematic cross-sectional plan view of a molecular drag stage in accordance with a fifth embodiment of the invention is shown in FIG. 8. A stator 400 defines a channel 402 that opens onto an upper surface of disk 302. Stator 400 includes a blockage 404 that defines an inlet and an outlet of channel 402. Channel 402 receives gas to be pumped through an inlet conduit 406 on one side of blockage 404 and discharges gas through an exhaust conduit 408 on the opposite side of blockage 404.

The channel 402 in stator 400 is defined by walls which alternate in direction, but follow a roughly circular path, to define a zigzag channel. Thus, channel 402 includes sections 410, 412, 414, etc. which alternate in direction to define a zigzag channel. The changes in wall direction serve as obstructions to smooth gas flow and thereby reduce the tendency for backward flow in channel 402. The size of the changes in direction of channel 402 and the number of changes in direction are selected depending on the application of the molecular drag stage. Further, the changes in direction of the channel can be produced by variations in the outer wall of channel 402, the inner wall of channel 402, the top wall of channel 402 or some combination of the channel walls. In one example, the inner and outer walls of channel 402 have more or less matching changes of direction.

Figure 9:
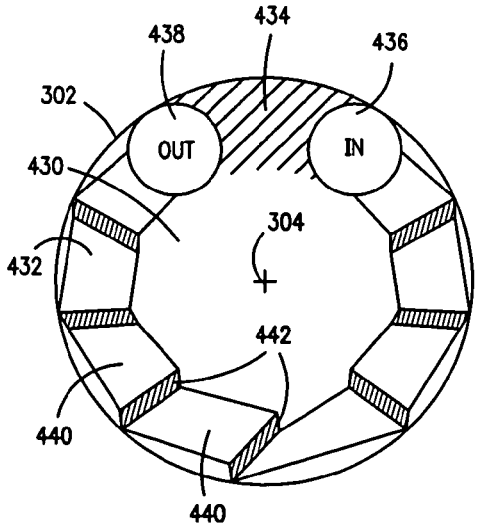

A schematic cross-sectional plan view of a molecular drag stage in accordance with a sixth embodiment of the invention is shown in FIG. 9. A stator 430 defines a channel 432 that opens onto an upper surface of disk 302. Stator 430 includes a blockage 434 that defines an inlet and an outlet of channel 432. Channel 432 receives gas to be pumped through an inlet conduit 436 on one side of blockage 434 and discharges gas through an exhaust conduit 438 on the opposite side of blockage 434.

In the embodiment of FIG. 9, the top wall of channel 432 includes multiple ramps 440, each terminating in a step 442. The steps 442 face the direction of gas flow in channel 432 and function as obstructions to smooth gas flow, thereby producing turbulence and reducing the tendency for backward flow in channel 432. Ramps 440 and steps 442 may have flat or curved surfaces. The dimensions and shapes of ramps 440 and steps 442 are selected depending on the application of the molecular drag stage.

Figure 10:
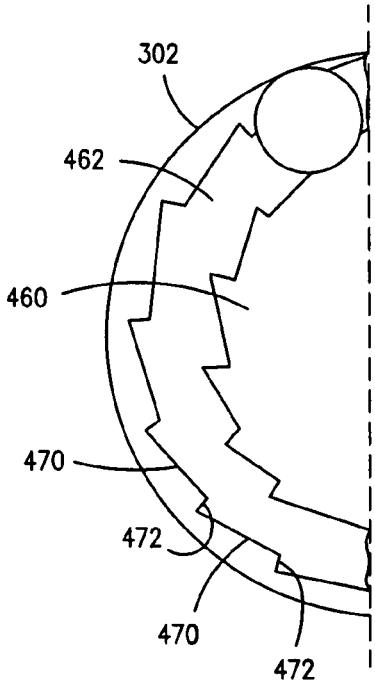
FIGS. 10-12 are partial schematic plan views of molecular drag stages in accordance with embodiments of the invention.

A schematic cross-sectional plan view of a molecular drag stage in accordance with a seventh embodiment of the invention is shown in FIG. 10. One half of the circular molecular drag stage is shown. A stator 460 defines a channel 462 that opens onto an upper surface of disk 302. In the embodiment of FIG. 10, inner and outer walls of channel 462 include ramps 470, each terminating in a step 472. The steps 472 function as obstructions to the smooth flow of gas through channel 462 and thereby produce turbulence and reduce the tendency for backward flow in channel 462.

Figure 11:
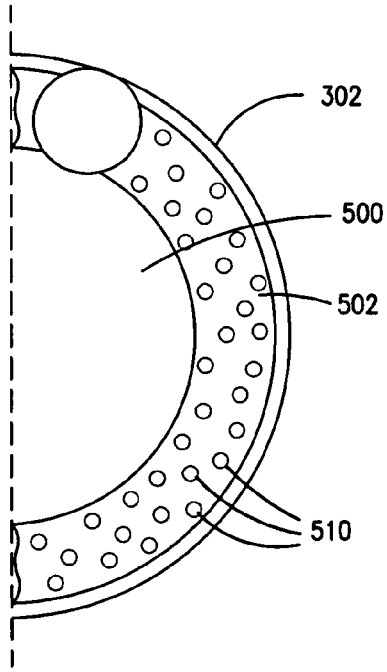

A schematic cross-sectional plan view of a molecular drag stage in accordance with an eighth embodiment of the invention is shown in FIG. 11. One half of a circular molecular drag stage is shown. A stator 500 defines a channel 502 that opens onto an upper surface of disk 302. In the embodiment of FIG. 11, multiple posts 510 extend from the top wall of channel 502 into channel 502. The posts 510 function as obstructions to the smooth flow of gas through channel 502 and thereby produce turbulence and reduce the tendency for backward flow. The number and size of posts 510, as well as their placement in channel 502, are selected according to the application of the molecular drag stage.

Figure 12:
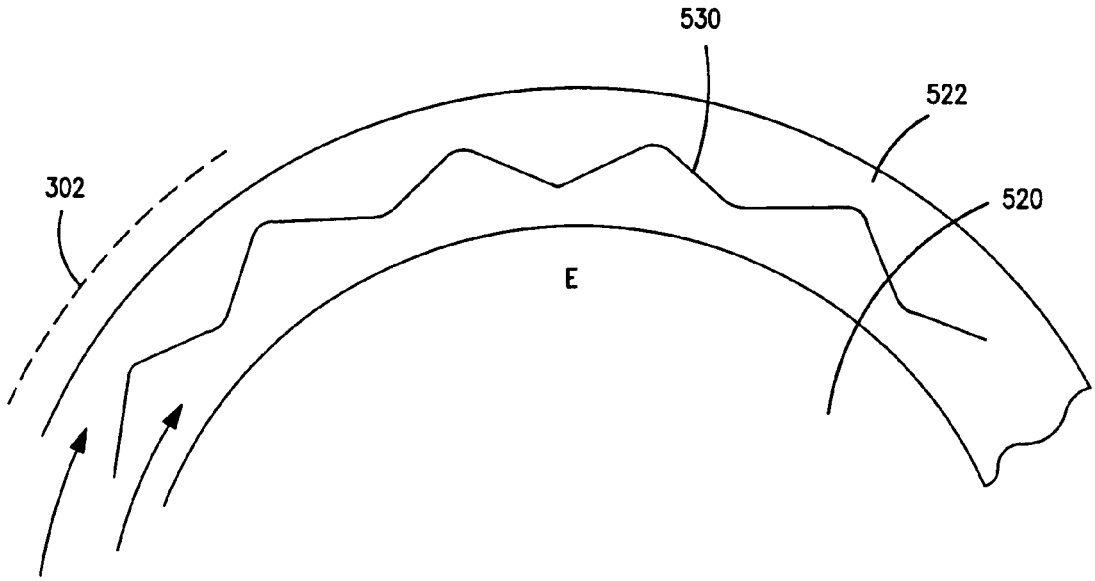

A schematic partial cross-sectional plan view of a molecular drag stage in accordance with a ninth embodiment of the invention is shown in FIG. 12. An arc-shaped section of the circular molecular drag stage is shown. A stator 520 defines a channel 522 that opens onto an upper surface of disk 302. In the embodiment of FIG. 12, a circumferential rib or divider 530 extends into channel 522 from a top wall thereof. Divider 530 includes multiple changes of direction which produce a zigzag configuration. The zigzag divider 530 functions as an obstruction to the smooth flow of gas through channel 522 and thereby produces turbulence and reduces the tendency for backward flow. The configuration of divider 530, including the number and size of direction changes, is selected according to the application of the molecular drag stage.

Various channel configurations have been shown and described to limit the tendency for backward flow in the channel. The shape, dimensions and number of the obstructions in the channel may be selected, depending on the expected operating pressure of the molecular drag stage in the vacuum pump. In a vacuum pump having two or more molecular drag stages, the shape, dimensions and number of obstructions in the channel of each stage may be selected according to the expected operating pressure of the respective stage. Therefore, different stages of the same vacuum pump may have different channel configurations.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A vacuum pump comprising:

a housing having an inlet port and an exhaust port;

at least one molecular drag stage located within the housing and disposed between the inlet port and the exhaust port, the molecular drag stage including a rotor comprising a molecular drag disk and a stator that defines a tangential flow channel, which opens onto a surface of the disk, the stator further defining at least one obstruction in the channel including a plurality of posts extending therein so as to induce turbulent flow in a selected pressure range for reducing backward flow under viscous or partially viscous flow; and a motor to rotate the rotor of the molecular drag stage so that gas is pumped from the inlet port to the exhaust port.

2. The vacuum pump as defined in claim 1, wherein the at least one obstruction includes a plurality of obstructions.

3. A vacuum pump comprising:

a housing having an inlet port and an exhaust port;

at least one molecular drag stage located within the housing and disposed between the inlet port and the exhaust port, the molecular drag stage including a rotor and a stator, the stator defining a tangential flow channel which opens onto a surface of the rotor, a baffle that blocks the channel at a circumferential location, and at least one obstruction in the channel comprising a plurality of posts extending therein that alter gas flow through the channel for reducing the backward flow under viscous or partially viscous flow; and a motor to rotate the rotor of the molecular drag stage so that gas is pumped from the inlet port to the exhaust port.

4. The vacuum pump as defined in claim 3, wherein the at least one obstruction includes a plurality of obstructions.

5. The vacuum pump as defined in claim 3, wherein at least one obstruction is configured to produce turbulence in the channel under viscous flow conditions.

6. A vacuum pump comprising:

a housing having an inlet port and an exhaust port;

at least one molecular drag stage located within the housing and disposed between the inlet port and the exhaust port, the molecular drag stage including a rotor comprising a molecular drag disk and a stator that defines a tangential flow channel, which opens onto a surface of the disk, the stator further defining at least one obstruction in the channel including a circumferential divider disposed in the channel, the circumferential divider having a configuration that changes direction in an alternating fashion so as to induce turbulent flow in a selected pressure range for reducing backward flow under viscous or partially viscous flow; and a motor to rotate the rotor of the molecular drag stage so that gas is pumped from the inlet port to the exhaust port.

7. A vacuum pump comprising:

a housing having an inlet port and an exhaust port;

at least one molecular drag stage located within the housing and disposed between the inlet port and the exhaust port, the molecular drag stage including a rotor and a stator, the stator defining a tangential flow channel which opens onto a surface of the rotor, a baffle that blocks the channel at a circumferential location, and one or more obstructions in the channel including a circumferential divider disposed therein, the circumferential divider having a configuration that changes direction in an alternating fashion; and a motor to rotate the rotor of the molecular drag stage so that gas is pumped from the inlet port to the exhaust port.

8. The vacuum pump as defined in claim 7, wherein the one or more obstructions are configured to produce turbulence in the channel under viscous flow conditions for reducing the backward flow.

* * * * *